US005536067A

United States Patent [19]

Pinto

[11] Patent Number: 5,536,067

[45] Date of Patent: Jul. 16, 1996

[54] CHAIR

[76] Inventor: Shlomo Pinto, 8 Daniel Frisch, Tel Aviv, Israel

[21] Appl. No.: 288,382

[22] Filed: Aug. 10, 1994

[51] Int. Cl.[6] ..... A47C 3/025

[52] U.S. Cl. ..... 297/284.11; 297/215.15; 297/312; 297/423.13

[58] Field of Search ..... 297/284.11, 201, 297/203, 215.15, 284.3, 312, 337, 423.11, 423.13

[56] References Cited

U.S. PATENT DOCUMENTS

| | | | |
|---|---|---|---|
| 635,234 | 10/1899 | Chance | 297/215.15 X |
| 1,619,686 | 3/1927 | Witkowski | 297/284.11 |
| 3,446,532 | 5/1969 | Cramer | 297/337 X |
| 4,521,053 | 6/1985 | de Boer | 297/312 |
| 5,401,077 | 3/1995 | Hosoe | 297/312 |

FOREIGN PATENT DOCUMENTS

| | | | |
|---|---|---|---|
| 85000275 | 1/1985 | WIPO | 297/423.13 |

*Primary Examiner*—Laurie K. Cranmer
*Attorney, Agent, or Firm*—Mark M. Friedman

[57] ABSTRACT

A chair on which a user assumes a kneel-like sitting posture. The chair includes a floor-engaging support and a seat mounted on the support. The seat includes a posterior and leg supporting seating portion articulatable with respect to the support between a substantially horizontal plane and a forward downward inclined plane in which a user assumes the kneeling-like sitting posture, and a crotch supporting tongue for supporting the user in the kneeling-like sitting posture. The chair also includes seating portion adjustment apparatus for inclining the seating portion into the forward downward inclined plane.

6 Claims, 3 Drawing Sheets

CHAIR

FIELD AND BACKGROUND OF THE INVENTION

The present invention relates to sitting devices in general and, more particularly, to chairs on which a user assumes a kneeling-like sitting posture.

It is well known that sitting in a conventional chair for long periods can be discomforting. Furthermore, it is also well known that conventional chairs often cause back and muscle pain complaints due to excessive pressure on the lower back when sitting in the normal 90° angle sitting position.

Chairs which have attempted to solve this problem include chairs on which the user assumes a kneel-like sitting posture. These chairs are typified by at least part of the user's weight being supported by a pad against which the user's knees or the user's shins are applied to prevent the user from sliding forward when sitting in the kneel-like position.

Examples of such chairs are described in the following patents:

U.S. Pat. No. 4,848,841 to Giselsson describes a sitting device having a main frame, a seat pivotally mounted on the main frame and a separate knee support, which is pivotally mounted in one end each of supporting arms, which have their other ends pivotally mounted in links of a link system, one pair of the links being prolonged by an arm which extends between the frame and the seat.

U.S. Pat. No. 4,793,655 to Kvalheim describes having a seat rest cushion and support and a separate back rest cushion and support. The cushions are mounted on the chair frame and interconnected by a mechanism which permits swinging the back rest cushion downwards to a knee rest position while tilting the seat rest cushion forward to a enable a person to assume a knee rest position on the chair.

U.S. Pat. No. 4,589,699 to Dungan describes a chair having a seat and a knee rest, both of which have dedicated angular tilting arrangements.

WO Pat. No. 85/00275 describes a chair having a seat which is partitioned into two parts, the lower part serving to provide support for one or both of the user's shins.

These and similar kneel-like sitting posture devices suffer from several disadvantages. First, it is often difficult and awkward to sit down and get off from these types of chair. And second, a considerable portion of the weight of the user is transferred to the user's knee, thus increasing pressure on the knee joint which in turn can cause medical problems.

Thus, there is a widely recognized need for, and it would be highly advantageous to have, a chair on which a user assumes a kneel-like sitting posture which overcomes the above mentioned deficiencies.

SUMMARY OF THE INVENTION

The present invention is of a chair on which a user assumes a kneel-like sitting posture.

Hence, according to a first aspect of the present invention, there s provided a chair on which a user assumes a kneel-like sitting posture, the chair comprising: (a) a floor-engaging support; (b) a seat mounted on the support, the seat including: i) a posterior and leg supporting seating portion, articulatable with respect to the support between a substantially horizontal plane and a forward downward inclined plane in which a user assumes the kneeling-like sitting posture, and ii) a crotch supporting tongue for supporting the user in the kneeling-like sitting posture; and (c) seating portion adjustment means for inclining the seating portion into the forward downward inclined plane.

According to a further feature of the present invention, the chair further comprising tongue adjustment means for inclining the crotch supporting tongue between a substantially horizontal plane and a rearward downward inclined plane with respect to the support.

There is also provided according to a second aspect of the present invention, a chair on which a user assumes a kneel-like sitting posture, the chair comprising: (a) a floor-engaging support; (b) a seat mounted on the support, the seat including: i) a posterior supporting rear portion, ii) a leg supporting front portion articulatable with respect to the support between a substantially horizontal plane and a forward downward inclined plane in which a user assumes the kneeling-like sitting posture, and iii) a crotch supporting tongue for supporting the user in the kneeling-like sitting posture; and (c) front portion adjustment means for inclining the front portion forward downward.

According to a further feature of the present invention, the crotch supporting tongue is an extension of the posterior supporting rear portion.

According to a still further feature of the present invention, the leg supporting front portion is bifurcated for receiving the tongue when the front portion is deployed in the substantially horizontal plane.

According to a yet still further feature of the present invention, the chair further comprising tongue adjustment means for inclining the crotch supporting tongue between a substantially horizontal plane and a rearward downward inclined plane with respect to the support.

According to a yet still further feature of the present invention, the chair further comprising rear portion adjustment means for inclining the posterior supporting rear portion between a substantially horizontal plane and a forward downward inclined position with respect to the support.

There is also provided according to a third aspect of the present invention, a chair on which a user assumes a kneel-like sitting posture, the chair comprising: (a) a floor-engaging support; (b) a chassis mounted on the support, the chassis articulatable with respect to the support between a substantially horizontal plane and a downward inclined plane in which a user assumes the kneeling-like sitting posture; (c) a seat mounted on the chassis, the seat including: i) a posterior supporting rear portion, ii) a leg supporting front portion, and iii) a crotch supporting tongue for supporting a user in the kneeling-like sitting posture, the tongue articulatable between a forward downward inclined plane and a substantially horizontal plane with respect to the support; (d) chassis adjustment means for inclining the chassis into the forward downward plane; and (e) tongue adjustment means for inclining the tongue into the substantially horizontal plane.

According to a further feature of the present invention, the crotch supporting tongue is an extension of the posterior supporting rear portion.

According to a still further feature of the present invention, the leg supporting front portion is bifurcated for receiving the tongue when the front portion and the tongue are deployed along the same plane.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is of a chair on which a user assumes a kneel-like sitting posture.

The principles and operation of the chair according to the present invention may be better understood with reference to the drawings and the accompanying description.

Figure 1A:
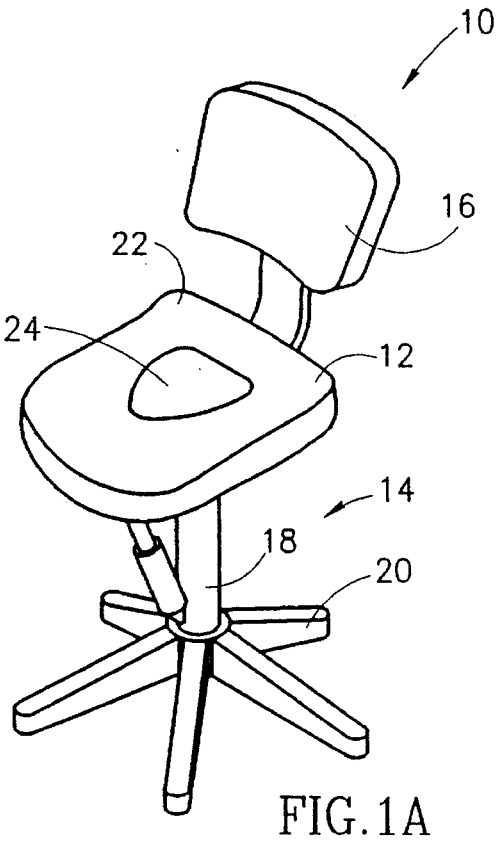
FIG 1*a* and 1*b* are schematic illustrations of a first embodiment of a chair on which a user assumes a kneel-like sitting posture, constructed and operative according to the teachings of the present invention, in two operative positions.
Figure 1B:
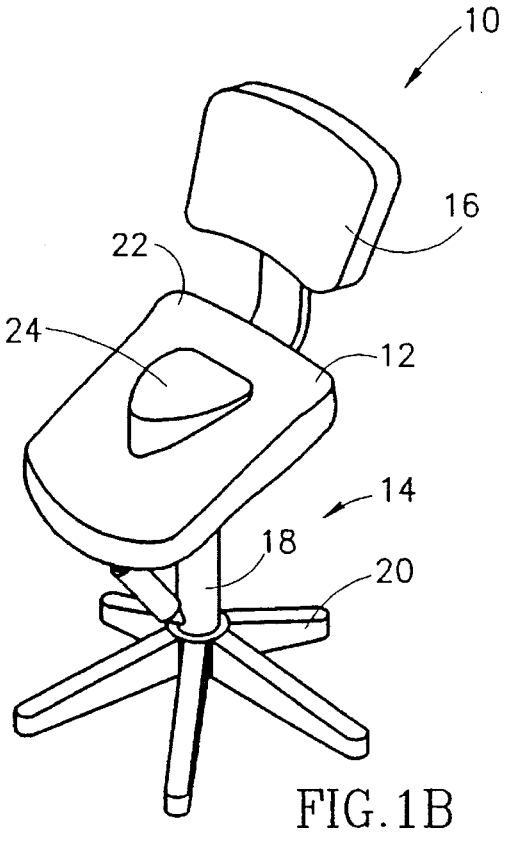

Referring now to the drawings, FIGS. 1*a* and 1*b* illustrate a first embodiment of a chair, generally designated 10, constructed and operative according to the teachings of the present invention, on which a user assumes a kneel-like sitting posture. Chair 10 includes a seat 12 mounted on a support 14 and provided with a back rest 16. Support 14 includes a standard 18 extending vertically from a base 20. The height of seat 12 can be adjusted.

Seat 12 is partitioned into a seating portion 22 and a tongue 24 substantially centrally deployed with respect to seat 12. Seating portion 22 can be articulated with respect to support 14 between a substantially horizontal plane as shown in FIG. 1*a* and a user regulated forward downward inclined plane as shown in FIG. 1*b* by means of a seating portion adjustment apparatus. Tongue 24 preferably lies flush with respect to seating portion 22 when seating portion 22 is deployed in its horizontal position. Suitable seating portion adjustment apparatus includes, but is not limited to, a gas spring, a slide block having an operating member securing the slide block in a desired position, a turnbuckle, a screw shackle, and the like. The seating portion adjustment apparatus is preferably manually operated. Furthermore, chair 10 can include tongue adjustment means for inclining crotch supporting tongue 24 between a substantially horizontal plane and a rearward downward inclined plane with respect to support 14.

The use of chair 10 is now described. First, chair 10 can be used as a conventional chair in the sense that both seating portion 22 and tongue 24 of seat 12 can be deployed in substantially the same horizontal plane as shown in FIG. 1*a*. Alternatively, chair 10 can be employed such that a user sitting thereon is induced to assume a kneel-like sitting posture. This is achieved by the user inclining seating portion 22 into a forward downward inclined position depending on his height, the height of the surface that he is working on, etc.

The kneel-like sitting posture is assumed by the user naturally changing his sitting posture by tilting his torso slightly forward and folding his legs under himself to prevent himself from sliding forward on forward downward inclined seat 12. In this kneel-like sitting posture, most of the user's weight is supported by seating portion 22 which supports the user's legs and the user's posterior. However, in contrast to conventional kneel-like sitting devices which employ supports for the user's knees or the user's shins, tongue 24 supports the user's crotch to prevent the user from sliding forward on forward downward inclined seat 12.

Figure 2A:
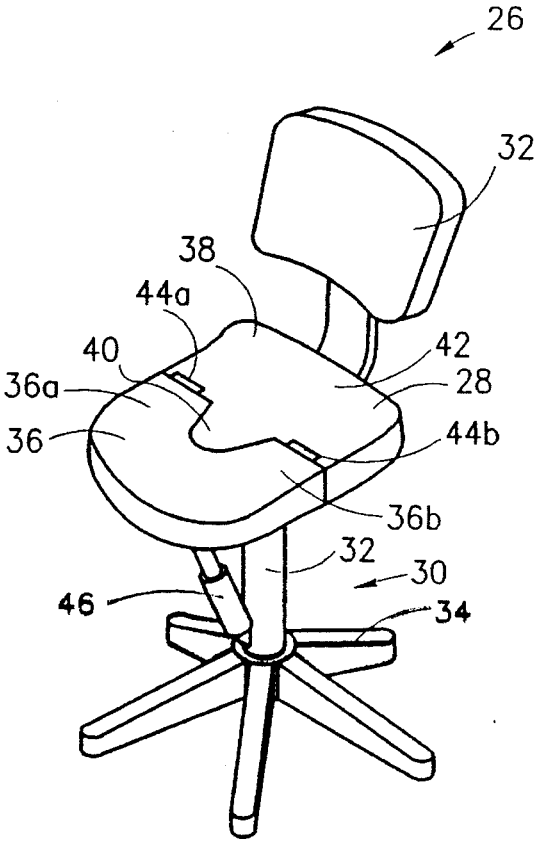
FIGS. 2*a* and 2*b* are schematic illustrations of a second embodiment of a chair on which a user assumes a kneel-like sitting posture, constructed and operative according to the teachings of the present invention, in two operative positions.
Figure 2B:
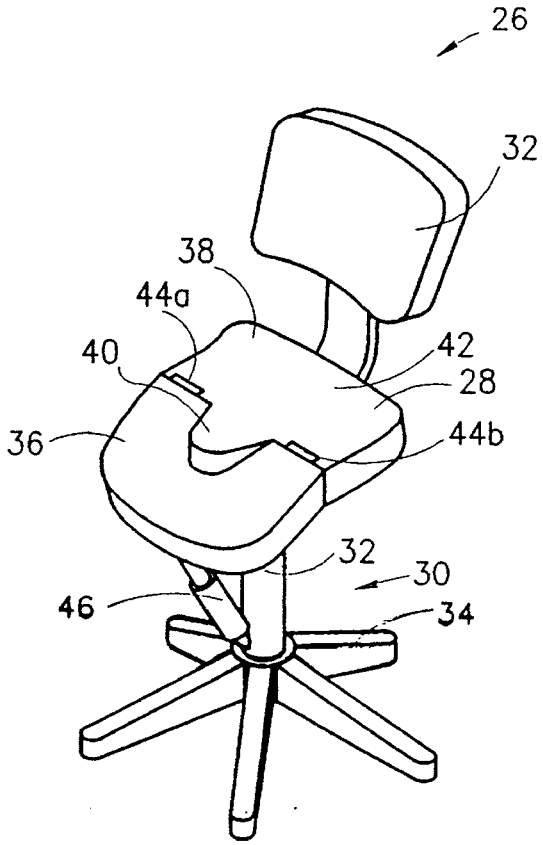

With reference now to FIGS. 2*a* and 2*b*, the schematic illustrations depict a second embodiment of a chair, generally designated 26, constructed and operative according to the teachings of the present invention, on which a user assumes a kneel-like sitting posture. Chair 26 includes a seat 28 mounted on a support 30 and provided with a back rest 32. Support 30 includes a standard 32 extending vertically from a base 34. The height of seat 28 can be adjusted.

Seat 28 is partitioned into a front portion 36 and a rear portion 38. Rear portion 38 preferably includes a tongue 40 projecting forwards from a substantially rectangular seating section 42 such that rear portion 38 takes on the overall appearance of a saddle or a bicycle seat. However, tongue 40 and seating section 42 can be provided as separate items as will be described hereinbelow with reference to FIGS. 3*a* and 3*b*. Front portion 36 is generally bifurcated or fork shaped such that its two prongs 36*a* and 36*b* receive tongue 40 therebetween when front portion 36 and rear portion 38 are deployed along the same plane as shown in FIG. 2*a*.

Front portion 36 can be articulated with respect to support 30 between a substantially horizontal plane as shown in FIG. 2*a* and a user regulated forward downward inclined plane as shown in FIG. 2*b* by means of a front portion adjustment apparatus. Rear portion 38 preferably lies flush with respect to front portion 36 when front portion 36 is deployed in its horizontal position. Suitable front portion adjustment apparatus includes, but is not limited to, a gas spring, a slide block having an operating member securing the slide block in a desired position, a turnbuckle, a screw shackle, and the like. Front portion adjustment apparatus is preferably manually operated.

The articulation of front portion 36 is preferably achieved by pivotally connecting the rear edge of prongs 36*a* and 36*b* to the front edge of seating section 42 by hinges 44*a* and 44*b* on either side of tongue 40 and pivotally connecting a selectively extendible gas spring 46 at its first end to front portion 36 and at its second end to standard 32. Hence, depending on the setting of gas spring 46, front portion 36 can be deployed in a substantially horizontal plane as shown in FIG. 2*a* and a forward downward inclined plane as shown in FIG. 2*b*.

The use of chair 26 is now described. First, chair 26 can be used as a conventional chair in the sense that both front portion 36 and rear portion 38 of seat 28 can be deployed in substantially the same horizontal plane as shown in FIG. 2*a*. Alternatively, chair 26 can be employed such that a user sitting thereon is induced to assume a kneel-like sitting posture. This is achieved by the user inclining front portion 36 into a forward downward inclined position depending on his height, the height of the surface that he is working on, etc.

The kneel-like sitting posture is assumed by the user naturally changing his sitting posture by tilting his torso slightly forward and folding his legs under himself to prevent himself from sliding forward on forward downward inclined seat 28. In this kneel-like sitting posture, most of the user's weight is supported by front portion 36 which supports the user's legs and seating section 42 which supports the user's posterior. However, in contrast to conventional kneel-like sitting devices which employ supports for the user's knees or the user's shins, tongue 40 supports the user's crotch to prevent the user from sliding forward on forward downward inclined seat 28.

Figure 3A:
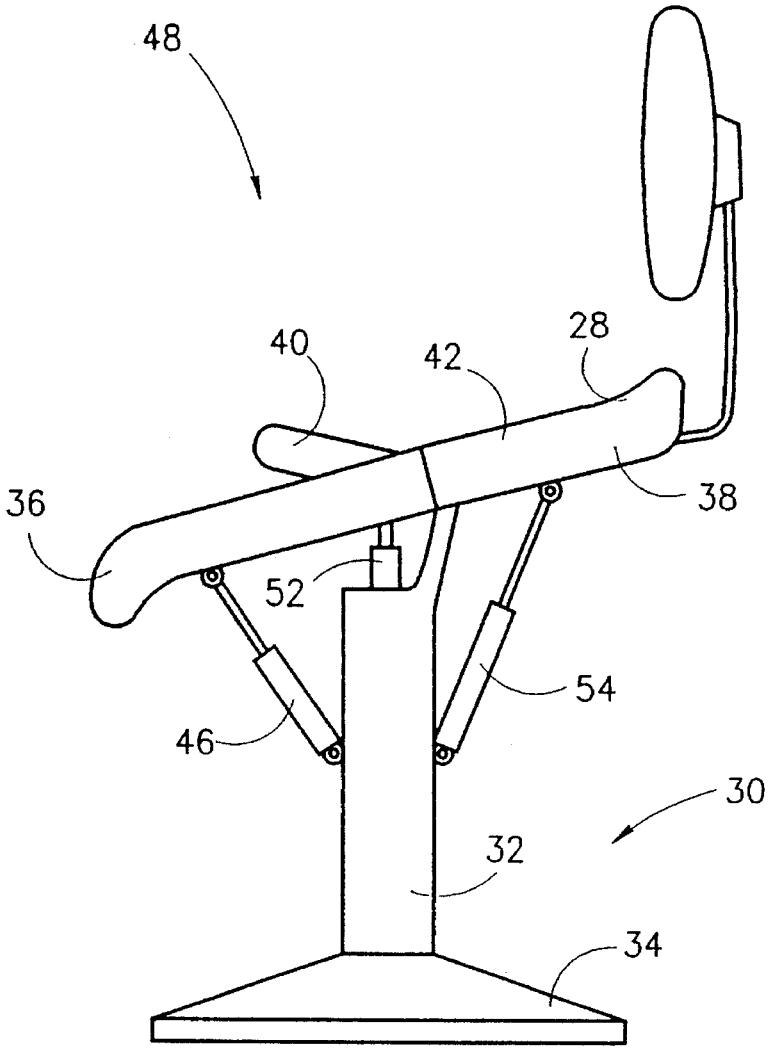
FIGS. 3*a* and 3*b* are side elevation and partial plan views, respectively, of a modified implementation of the chair of FIG. 2*a*.
Figure 3B:
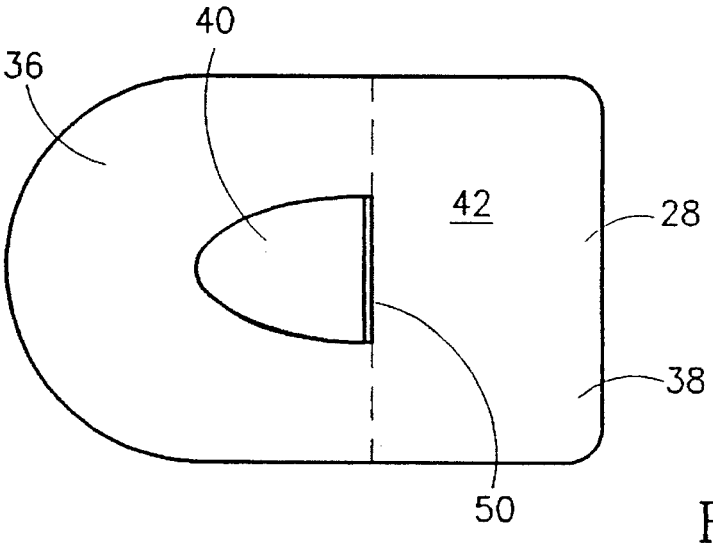

An improved implementation of chair 26, additionally designated 48, constructed and operative according to the teachings of the present invention, is illustrated in FIGS. 3*a* and 3*b*. In this case, as described hereinabove, tongue 40 and seating section 42 are provided as separate items individually mounted on support 30 while, preferably, the rear edge of tongue 40 is pivotally connected to the front edge of seating section 42 by a hinge 50.

Chair 48 enables tongue 40 to be articulated between a substantially horizontal plane and a rearward downward inclined plane with respect to support 30. Hence, chair 48 further includes a tongue adjustable apparatus, in the form of a gas spring 52, pivotally connected at its first end to tongue 40 and at its second end to standard 32. In a similar fashion, chair 48 enables seating section 42 to be articulated between a substantially horizontal plane and a forward downward inclined plane with respect to support 30. Hence, chair 48 further includes seating section adjustable apparatus, in the form of a gas spring 54, pivotally connected at its first end to seating section 42 and at its second end to standard 32.

Figure 4B:
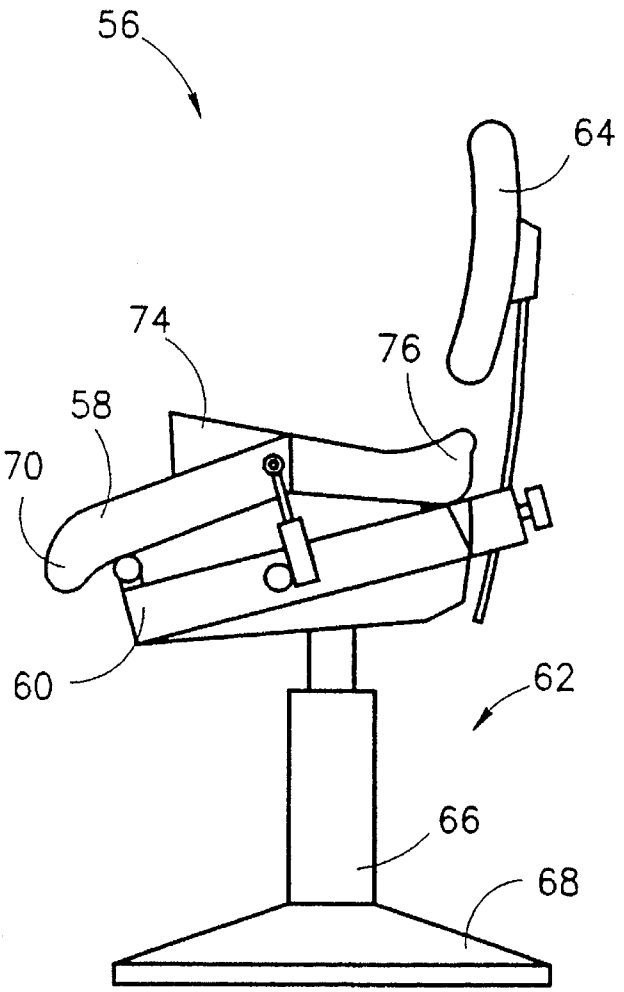
FIGS. 4*a* and 4*b* are schematic illustrations of a third embodiment of a chair on which a user assumes a kneel-like sitting posture, constructed and operative according to the teachings the present invention, in two operative positions.
Figure 4A:
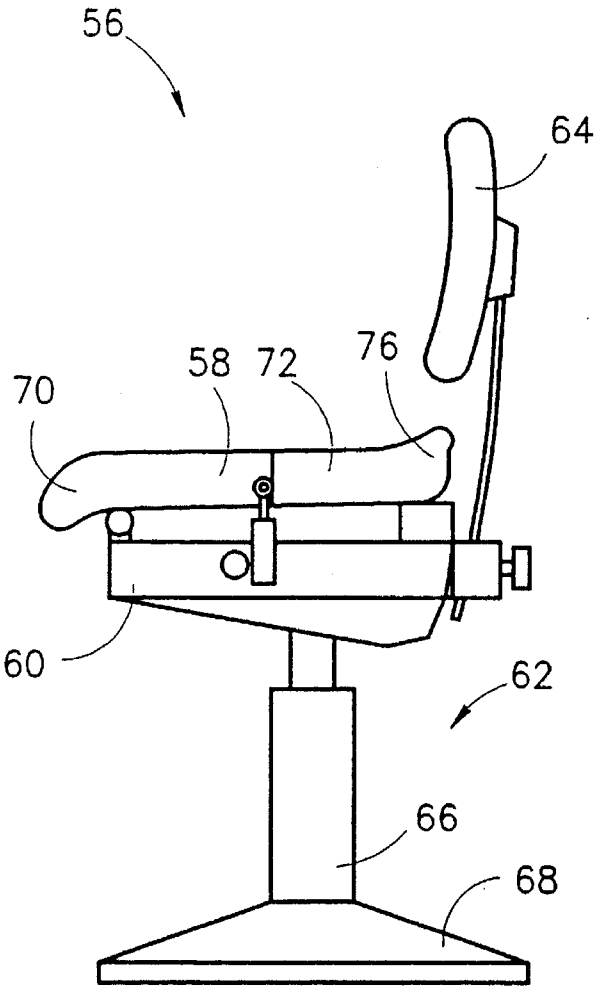

With reference now to FIGS. 4*a* and 4*b*, there is shown a third embodiment of a chair, generally designated 56, constructed and operative according to the teachings of the present invention, on which a user assumes a kneel-like sitting posture. Chair 56 includes a seat 58 mounted on a chassis 60 which is, in turn, pivotally mounted on a support 62 between a substantially horizontal plane as shown in FIG. 4*a* and a user regulated forward downward inclined plane as shown in FIG. 4*b* by means of a chassis adjustment apparatus. Suitable chassis adjustment apparatus includes, but is not limited to, a gas spring, a slide block having an operating member securing the slide block in a desired position, a turnbuckle, a screw shackle, and the like. Chassis adjustment apparatus is preferably manually operated. The height of seat 58 can be adjustable. Chair is preferably provided with a back rest 64. Support 62 includes a standard 66 extending vertically from a base 68.

In a similar fashion to seat 28, seat 58 is partitioned into a front portion 70 and a rear portion 72. Rear portion 72 preferably includes a tongue 74 projecting forward from a substantially rectangular seating section 76 such that rear portion 72 takes on the overall appearance of a saddle or a bicycle seat. Front portion 70 is generally bifurcated or fork shaped such that its two prongs receive tongue 74 therebetween when front portion 70 and rear portion 72 are deployed along the same plane parallel to chassis 60 as shown in FIG. 4*a*.

Tongue 74 can be articulated with respect to chassis 60 between a substantially parallel plane as shown in FIG. 4*a* and a user regulated rearward downward inclined plane as shown in FIG. 4*b* by means of a tongue adjustment apparatus, for example, gas spring 78. As described hereinabove, tongue 74 support the crotch of the user when to prevent the user from sliding forward on forward downward inclined seat 58.

At the same time, tongue adjustment apparatus 78 adjusts both the inclinations of front portion 70 and seating section 76 with respect to chassis 60 such that front section 70 is inclined in a similar forward downward inclined plane with respect to chassis 60 while seating section 76 is inclined in a rearward downward inclined plane with respect to chassis 60. Alternatively, chair 56 can include tongue 74 and seating section 76 provided as separate items similar to chair 48. Also, chair 56 can be provided with front portion adjustment apparatus and seating portion adjustment apparatus.

While the invention has been described with respect to a limited number of embodiments, it will be appreciated that many variations, modifications and other applications of the invention may be made.

What is claimed is:

1. A chair on which a user assumes a kneel-like sitting posture, the chair comprising:

(a) a floor-engaging support;

(b) a seat mounted on said support, said seat including:

i) a posterior and leg supporting seating portion, articulatable with respect to said support between a substantially horizontal plane and a forward downward inclined plane in which a user assumes the kneeling-like sitting posture, and ii) a crotch supporting tongue hinged to said seating portion for supporting the user in the kneeling-like sitting posture, said crotch supporting tongue being discretly formed from said posterior and leg supporting seating portion; and (c) seating portion adjustment means for inclining said seating portion into said forward downward inclined plane.

2. The chair as in claim 1, further comprising tongue adjustment means for inclining said crotch supporting tongue between a substantially horizontal plane and a rearward downward inclined plane with respect to said support.

3. A chair on which a user assumes a kneel-like sitting posture, the chair comprising:

(a) a floor-engaging support;

(b) a seat mounted on said support, said seat including:

i) a posterior supporting rear portion, ii) a leg supporting front portion articulatable with respect to said support between a substantially horizontal plane and a forward downward inclined plane in which a user assumes the kneeling-like sitting posture, and iii) a crotch supporting tongue hinged to said posterior supporting rear portion for supporting the user in the kneeling-like sitting posture, said crotch supporting tongue being separate from said posterior supporting rear portion; and (c) front portion adjustment means for inclining said front portion forward downward.

4. The chair as in claim 3, wherein said leg supporting front portion is bifurcated for receiving said tongue when said front portion is deployed in said substantially horizontal plane.

5. The chair as in claim 3, further comprising tongue adjustment means for inclining said crotch supporting tongue between a substantially horizontal plane and a rearward downward inclined plane with respect to said support.

6. The chair as in claim 3, further comprising rear portion adjustment means for inclining said posterior supporting rear portion between a substantially horizontal plane and a forward downward inclined position with respect to said support.

* * * * *